US010927572B2

(12) United States Patent
Inan

(10) Patent No.: US 10,927,572 B2
(45) Date of Patent: Feb. 23, 2021

(54) MOTOR VEHICLE DOOR LOCK

(71) Applicant: Kiekert AG, Heiligenhaus (DE)

(72) Inventor: Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 665 days.

(21) Appl. No.: 15/553,624

(22) PCT Filed: Feb. 12, 2016

(86) PCT No.: PCT/DE2016/100065

§ 371 (c)(1),
(2) Date: Oct. 30, 2017

(87) PCT Pub. No.: WO2016/134697

PCT Pub. Date: Sep. 1, 2016

(65) Prior Publication Data

US 2018/0044953 A1 Feb. 15, 2018

(30) Foreign Application Priority Data

Feb. 25, 2015 (DE) ..... 10 2015 002 451.5

(51) Int. Cl.
*E05B 79/10* (2014.01)
*E05B 79/20* (2014.01)
(Continued)

(52) U.S. Cl.
CPC ..... *E05B 79/10* (2013.01); *E05B 63/143* (2013.01); *E05B 77/32* (2013.01); *E05B 79/20* (2013.01);
(Continued)

(58) Field of Classification Search
CPC ..... E05B 77/46; E05B 77/465; E05B 81/06; E05B 81/16; E05B 77/48; E05B 77/50;
(Continued)

(56) References Cited

U.S. PATENT DOCUMENTS 4,505,500 A * 3/1985 Utsumi ..... E05B 83/38 292/48
5,603,537 A 2/1997 Amano
(Continued)

FOREIGN PATENT DOCUMENTS

DE 19517525 A1 11/1995
DE 10210797 A1 12/2003
(Continued)

OTHER PUBLICATIONS

Machine Translation of DE 102009051432 A1, 2020, pp. 1-12 (Year: 2020).*
(Continued)

*Primary Examiner* — Christine M Mills
(74) *Attorney, Agent, or Firm* — Renner, Otto, Boisselle & Sklar, LLP

(57) ABSTRACT

The invention relates to a motor vehicle door lock (1) which comprises a locking mechanism having: a rotary latch and at least one pawl; a release lever (12); a locking device (21), the release lever (12) cooperating with the locking device (21) via a coupling lever (13); and an actuating lever (8), the locking mechanism being at least indirectly unlockable by means of the actuating lever (8). An additional motor vehicle door lock (2) is provided, and said vehicle door lock (2) can be actuated via a second coupling lever (14) and by means of the actuating lever (8), the first and the second coupling lever (13, 14) having a common pivot axis (15).

17 Claims, 8 Drawing Sheets

Figure 1:
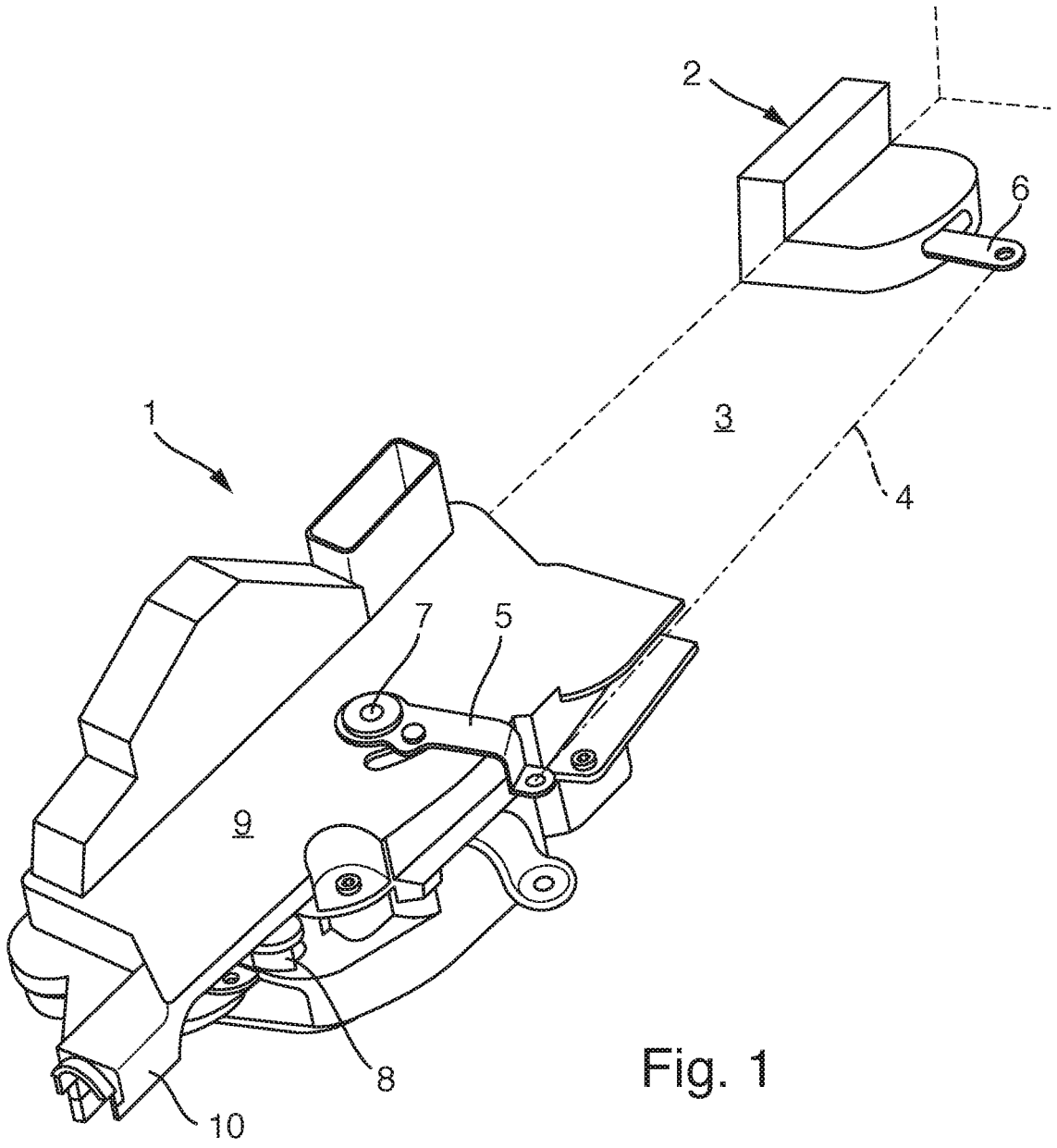

(51) Int. Cl.

| | |
|---|---|
| ***E05B 81/16*** | (2014.01) |
| ***E05B 83/40*** | (2014.01) |
| ***E05B 77/32*** | (2014.01) |
| ***E05B 81/06*** | (2014.01) |
| ***E05B 81/36*** | (2014.01) |
| ***E05B 85/20*** | (2014.01) |
| ***E05B 63/14*** | (2006.01) |

(52) U.S. Cl.
CPC ..... *E05B 81/06* (2013.01); *E05B 81/16* (2013.01); *E05B 81/36* (2013.01); *E05B 83/40* (2013.01); *E05B 85/20* (2013.01)

(58) Field of Classification Search
CPC ..... E05B 77/54; E05B 79/08; E05B 79/10; E05B 79/20; E05B 83/40; E05B 79/12; E05B 79/14; E05B 79/16; E05B 63/143; E05B 77/32; E05B 81/36; E05B 85/20; E05B 83/38; Y10S 292/23; Y10S 292/03; Y10T 292/1082; Y10T 292/1047; Y10T 292/0848; Y10T 292/0849; Y10T 292/0853; Y10T 292/0857; Y10T 292/1045; Y10T 292/1048
USPC ..... 292/201, 216, 44, 45, 48, 52, 214, 217, 292/DIG. 23, DIG. 3
See application file for complete search history.

(56) References Cited

U.S. PATENT DOCUMENTS

| | | | | |
|---|---|---|---|---|
| 5,927,768 | A * | 7/1999 | Dallmann | E05C 9/02 292/139 |
| 6,722,714 | B2 * | 4/2004 | Ooe | E05B 81/06 292/216 |
| 7,434,854 | B2 * | 10/2008 | Fujimatsu | E05B 81/25 292/336.3 |
| 2007/0284892 | A1 * | 12/2007 | Nozawa | E05B 77/265 292/216 |
| 2013/0241213 | A1 * | 9/2013 | Cox | E05C 3/12 292/4 |
| 2016/0195126 | A1 * | 7/2016 | Heide | E05B 79/20 403/349 |
| 2018/0044952 | A1 * | 2/2018 | Inan | E05B 63/143 |
| 2018/0044953 | A1 * | 2/2018 | Inan | E05B 79/20 |
| 2019/0211588 | A1 * | 7/2019 | Graute | E05B 79/08 |
| 2019/0351952 | A1 * | 11/2019 | Hunt | E05B 83/18 |

FOREIGN PATENT DOCUMENTS

| | | | | |
|---|---|---|---|---|
| DE | 102004043220 | A1 * | 3/2006 | E05B 83/04 |
| DE | 102004061481 | A1 * | 6/2006 | E05B 77/48 |
| DE | 10 2006 020 344 | A1 | 10/2007 | |
| DE | 102006019336 | A1 | 10/2007 | |
| DE | 10 2009 051 432 | A1 | 5/2011 | |
| EP | 1 111 173 | A2 | 6/2001 | |
| GB | 2 105 777 | A | 3/1983 | |

OTHER PUBLICATIONS

International Search Report and Written Opinion for corresponding Patent Application No. PCT/DE2016/100065 dated Jun. 6, 2016.

* cited by examiner

MOTOR VEHICLE DOOR LOCK

The invention relates to a motor vehicle door latch having a locking mechanism, with a catch and at least a pawl, a triggering lever, a locking device, whereby the triggering lever interacts with the locking device by means of a coupling lever, an activation lever, whereby the locking mechanism can at least be indirectly unlocked by means of the activation lever.

Motor vehicle door latches are used to latch doors, flaps or hoods in a motor vehicle. If it is customary, for example, for a door latch to be used on passenger vehicles, this changes when the size of the door exceeds a certain size, for example. In order to guarantee that large doors are also latched properly in every area of the door opening, it can be necessary to use two or more door latches for the proper latching of the door. For example, this could be the case if vehicles are equipped without a B-pillar and the doors are assigned a stabilizing function for the frame. Furthermore, for example, sliding doors can require a second motor vehicle door latch. Several door latches are preferably used if the door is very high. When using two or more door latches, it is customary to use a required number of secondary latches in addition to a primary latch.

Primary and secondary latches are arranged in such a way that sufficient closing force is available at every location on the door opening in order to maintain the door in its closed position, to stabilize the motor vehicle and to provide sufficient closing force in order to keep the door sealed against the door seal. If, for example, the door is moved in the area of the hinges in a situation-related manner when closing against the door seal profile and positioned in the area of the hinges so that sufficient sealing pressure is generated in order to seal the door, this force needs to be applied by the motor vehicle door latch or set against the door seal in order to also position the door in a sealing manner in this area. If the door is very high, for example, it may be necessary to use one, two or more secondary latches in addition to the primary latch in order to generate relevant positioning forces which seal the door circumferentially.

An example of a sliding door with a primary latch and a number of secondary latches is known from DE10,2006/020344 A1. The sliding door is revealed there as an example with a primary latch and a multitude of secondary latches. By means of a common control unit and separate transmitters, all latching systems, such as the primary latch and secondary latches can be acted on in order to activate and/or deactivate these. An activation of the latching systems occurs as usual, for example, by means of an external door handle or an internal door handle, but it can also occur in a contactless manner by means of a sensor. Starting from the activation devices, the latches can then be activated or deactivated and/or an impact can be had on the locking or latching functions.

A class-specific motor vehicle door latch is known from DE10,2009/051432 A1. The motor vehicle door latch demonstrates a locking mechanism consisting of a catch and at least a pawl, whereby the catch can be engaged with a latch holder and the pawl ratchets the locking mechanism in the closed state of the door. In order to open the ratcheted locking mechanism, a coupling lever is connected to the pawl by means of a pin so that with a suitable alignment of the coupling lever and an activation of the coupling lever it can be activated in this example by means of an activation lever so that the locking mechanism can be unlocked. The coupling lever acts as a coupling between the pawl and the activation lever.

Starting from the known state of the art, the automotive industry strives towards reducing the weights of the motor vehicles and furthermore forming the number of components as uniformly as possible, preferably in a modular manner, whereby in addition a number of components which is as small as possible is striven towards. If a small number of components have a cost-reducing effect, the weight of the motor vehicle door latch can also be reduced hereby and the overall weight of the motor vehicle is thus reduced.

The invention is based on the task of providing an improved motor vehicle door latch to activate an additional latch. Furthermore, it is a task of the invention to provide a connection of an additional latch on a motor vehicle door latch which must be manufactured with a number of components which is as low as possible and is cost-effective and of a simple construction.

The task is solved according to the invention by the characteristics of the independent claims. Advantageous designs of the invention are specified in the sub-claims. It is pointed out that the embodiment examples described hereafter are not restrictive; instead, any possible variations are possible of the characteristics described in the description and the sub-claims.

According to patent claim 1, the task of the invention is solved by a motor vehicle door latch being provided having a locking mechanism with a catch and at least a pawl, a triggering lever, a locking device, whereby the triggering lever interacts with the locking device by means of a coupling lever, an activation lever, whereby by means of the activation lever the locking mechanism is at least indirectly unlockable and whereby a further motor vehicle latch is provided for and which can be activated by means of a second coupling lever and by means of the activation lever the further motor vehicle door latch can be activated, whereby the first and second coupling lever have a common pivoting axis. By means of the accommodation of the first and second coupling lever on a common pivoting axis, the possibility is now created of reducing the number of components and thus providing a construction to activate an additional latch which is as simple and cost-effective as possible. If the further motor vehicle door latch is activated by means of a second coupling lever, which is accommodated on the first coupling lever, and if the activation lever is simultaneously used to activate the further motor vehicle door latch, the possibility is thus given of uniformly distributing the forces required for triggering of the locking mechanism of the two motor vehicle door latches.

A further advantage is that no separate bearing or bearing point needs to be provided in the motor vehicle door latch for the second coupling lever; it is solely sufficient that the first coupling lever is formed in such a way that the second coupling lever can be pivotably accommodated on the first coupling lever.

If, within the scope of the invention, a locking mechanism is spoken of, this thus means the combination of a catch and at least a pawl, whereby the catch preferably interacts with a latch holder. The catch demonstrates an infeed section, into which the latch holder travels and pivots or rotates the catch during closure of the motor vehicle door. The pawl is pre-tensioned against the catch and blocks an opening movement of the catch to the extent that the latch holder is held in its position by the catch. A distinction is made between a pre-ratchet with an almost closed door and a main ratchet with a completely closed door. A triggering lever acts on the pawl to open the locking mechanism which disengages the pawl from the catch so that the latch holder is released and the door can be opened. A triggering lever can be present in the form of a lever, a pin or a mechanical drive, whereby the component is described as a triggering lever which directly or indirectly disengages the pawl from the catch.

A locking device is a device by means of which the triggering lever can be disengaged from the locking mechanism. If the motor vehicle door latch is bolted, the triggering lever or triggering mechanism is thus unable to disengage the pawl from the catch. In contrast, in the unbolted state the triggering mechanism or the triggering lever can unlock the locking mechanism. The triggering lever preferably interacts by means of a coupling lever with the locking device so that the locking mechanism can preferably be indirectly unlocked.

If, within the scope of the invention, a motor vehicle door latch is spoken of, this means door latches, latches, primary latches and secondary latches which can exert a latching effect onto a motor vehicle door. According to the invention, the motor vehicle door latch is a primary latch which activates an additional latch or secondary latch by means of the second coupling lever. A secondary latch or additional latch is arranged at a distance from the primary latch in the motor vehicle door and is preferably used for large doors or sliding doors, for example.

In one embodiment of the invention, the first coupling lever has an axis-type extension, whereby the second coupling lever is pivotably accommodated on the extension. A solution of a simple construction results when the coupling lever present in the motor vehicle door latch has an axis-type extension on which the second coupling lever can be mounted. Recourse to available components offers the possibility of having recourse to installed and proven components which assume an additional function. Furthermore, only a slight change needs to be undertaken to accommodate the second coupling lever in the motor vehicle latch. Accommodation on the first coupling lever also offers the advantage that a sufficient path, i.e. a sufficient angular movement for the second coupling lever is provided which is sufficient to securely unlock the locking mechanism. The first coupling lever acts directly on the locking mechanism or can at least act directly on the pawl and unlock the locking mechanism. The same path for unlocking is preferably present for the second coupling lever due to accommodation on the first coupling lever.

If the first coupling lever is pivotably accommodated by means of the extension in the triggering lever, a further advantageous embodiment of the invention thus results. Accommodation of the first coupling lever in the triggering lever causes the second coupling lever to also be accommodated in the triggering lever by means of the first coupling lever. Accommodation on the triggering lever offers the possibility that the triggering lever can act as a connection between an external activation lever and an internal activation lever of the motor vehicle door latch. The triggering lever can be pivotably accommodated in the motor vehicle door latch in such a way that by means of a pivoting movement of the internal activation lever or a pivoting movement of the external activation lever the triggering lever can be moved. The locking mechanism is then unlocked indirectly by means of the activation lever, for example the internal activation lever, the triggering lever and by means of the first coupling lever. This applies in particular for the motor vehicle door latch as a primary latch. With such a construction, the advantage is offered that recourse can be had directly to the activation lever present in the motor vehicle door latch without needing to undertake constructional changes to the primary latch. Only the mounting axis, i.e. the extension of the first coupling lever causes a constructional change for incorporation of the second coupling lever.

A further advantageous embodiment results when the second coupling lever is connected to the first coupling lever by means of a bayonet latch. A bayonet latch offers the possibility of easy installation and also by means of the formation of the bayonet latch the possibility of guaranteeing safe activation by means of the second activation lever. In particular in the case in which the second coupling lever executes an angular movement contrary to the first coupling lever or the same or different angular movement, by means of a bayonet latch a safe relative movement can be guaranteed between the first and second coupling lever. The first coupling lever is also preferably connected with the triggering lever by means of a bayonet latch.

If the first and second coupling lever execute concurrent angular movements to lock and unlock the motor vehicle door latch and the further motor vehicle door latch, a further embodiment form of the invention results. If the first and second coupling lever execute the same angular movement, a firm connection can be made between the first and second coupling lever by means of form-fitting and/or force-fitting. In particular, it is possible to also disengage the second coupling lever with the activation of the additional latch by means of the locking unit which disengages the first coupling lever with the locking mechanism. The same angular movements thus enable a uniform movement and a further reduction of the components required for locking or unlocking. Separate activation of the second coupling lever can thus be dispensed with.

A further embodiment of the invention results when the first and second coupling lever are formed as a single component. A single-component construction offers the advantage of cost-effective manufacture but also the advantage that safe transmission of an adjusting movement of one of the coupling levers can be safely transmitted to the other coupling lever. For example, by means of the present locking mechanism a locking function is thus directly executed for the additional latch. If the first coupling lever is disengaged with the locking mechanism by means of the locking device, the second coupling lever thus moves uniformly. Movement of the second coupling lever can also be used to disengage the second coupling lever from the activation chain for the additional latch. For example, a second activation lever can be accommodated in the motor vehicle door latch into which the second coupling lever engages, whereby by means of the second activation lever and, for example, a Bowden cable, the secondary latch or additional latch can be activated. Disengagement of the second coupling lever from the second activation lever would then cause a locking function.

If the first and second coupling levers are made of plastic, in particular are plastic injection-molded components, a further embodiment of the invention results. In addition to the good malleability of plastics and thus good adaptability to the spatial relationships in the motor vehicle door latch, plastic offers the advantage that plastic is lightweight. Light weights in turn have a positive effect on the overall weight of the motor vehicle door latch, so that not only a lower number of components, but also a lighter weight of the motor vehicle door latch can be reckoned with. Furthermore, the available plastics offer sufficient durable stability, heat resistance and strength to fulfill the requirements in a motor vehicle door latch.

If the locking device has a pivotably accommodated locking lever and if the motor vehicle door latch and the further motor vehicle door latch can be bolted and unbolted by means of a rotational movement of the locking lever, a further embodiment of the invention thus results. A rotatably accommodated locking lever which is constructed in a disk shape, for example, offers the advantage that several locking levers or drives or restrictors can engage on the circumference.

For example, a locking lever can be activated by means of an external locking, an internal locking or by means of an electromotorized drive. By means of the formation of an almost disk-shaped locking device or a locking lever the possibility thus exists of engaging onto the locking multiple times. Furthermore, the interplay with the triggering mechanism can also be executed in a constructionally cost-effective manner for the locking mechanism. An arm of the locking lever can thus interact with the first coupling lever and move or pivot the first and second coupling lever. The possibility is thus given of also locking or unlocking the additional latch or secondary latch by means of the present locking mechanism of the motor vehicle door latch. Hereby a motor vehicle door latch for connection to an additional latch is provided which provides a locking and activation function with a slight constructional change and with the least number of components.

The invention is described in further detail below with reference to the attached drawings on the basis of the preferred embodiments. However, the principle applies that the embodiment example does not restrict the invention but only constitutes an advantageous embodiment. The characteristics depicted can be executed individually or in combination, individually or in combination with other characteristics of the description, as also the patent claims.

Figure 2:
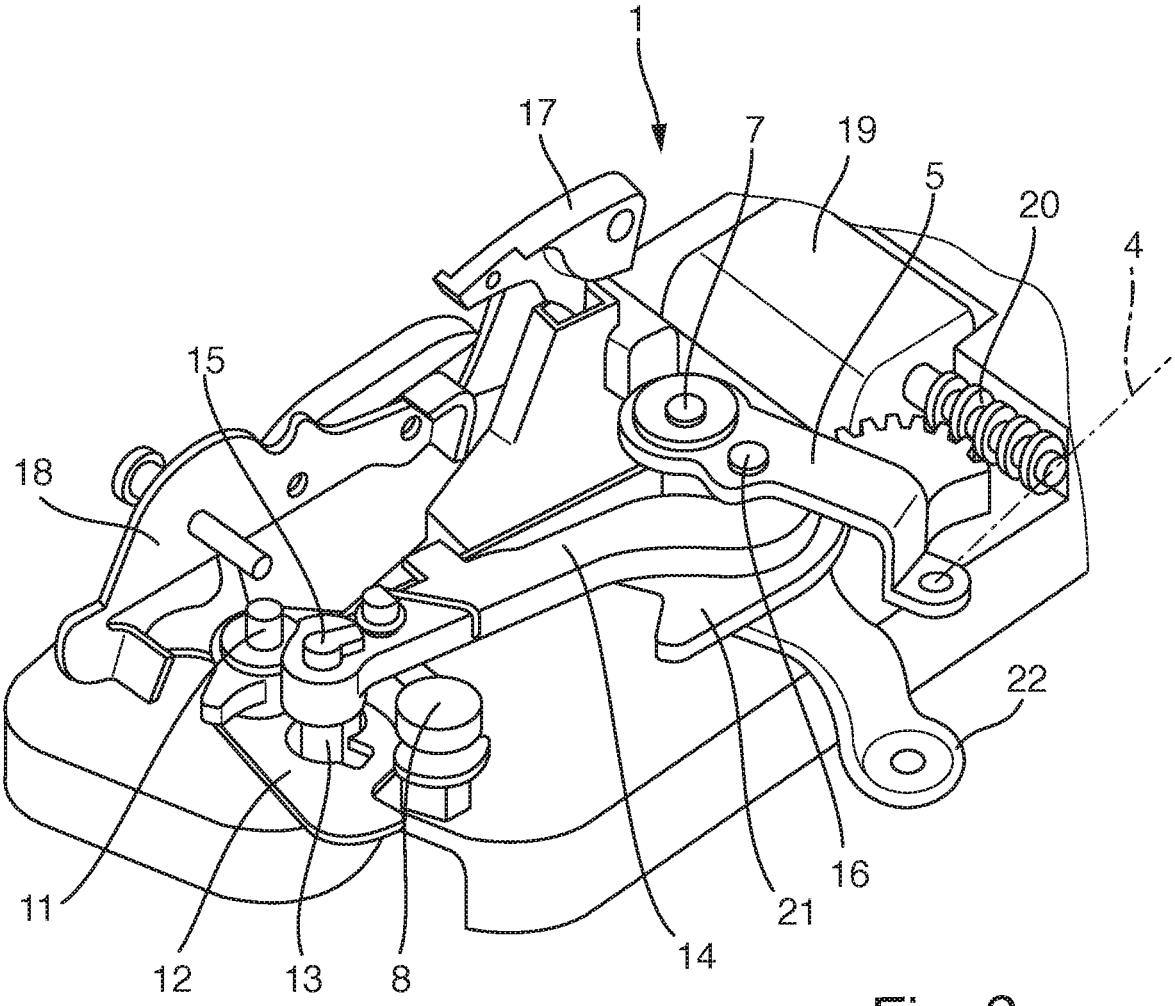
Figure 3:
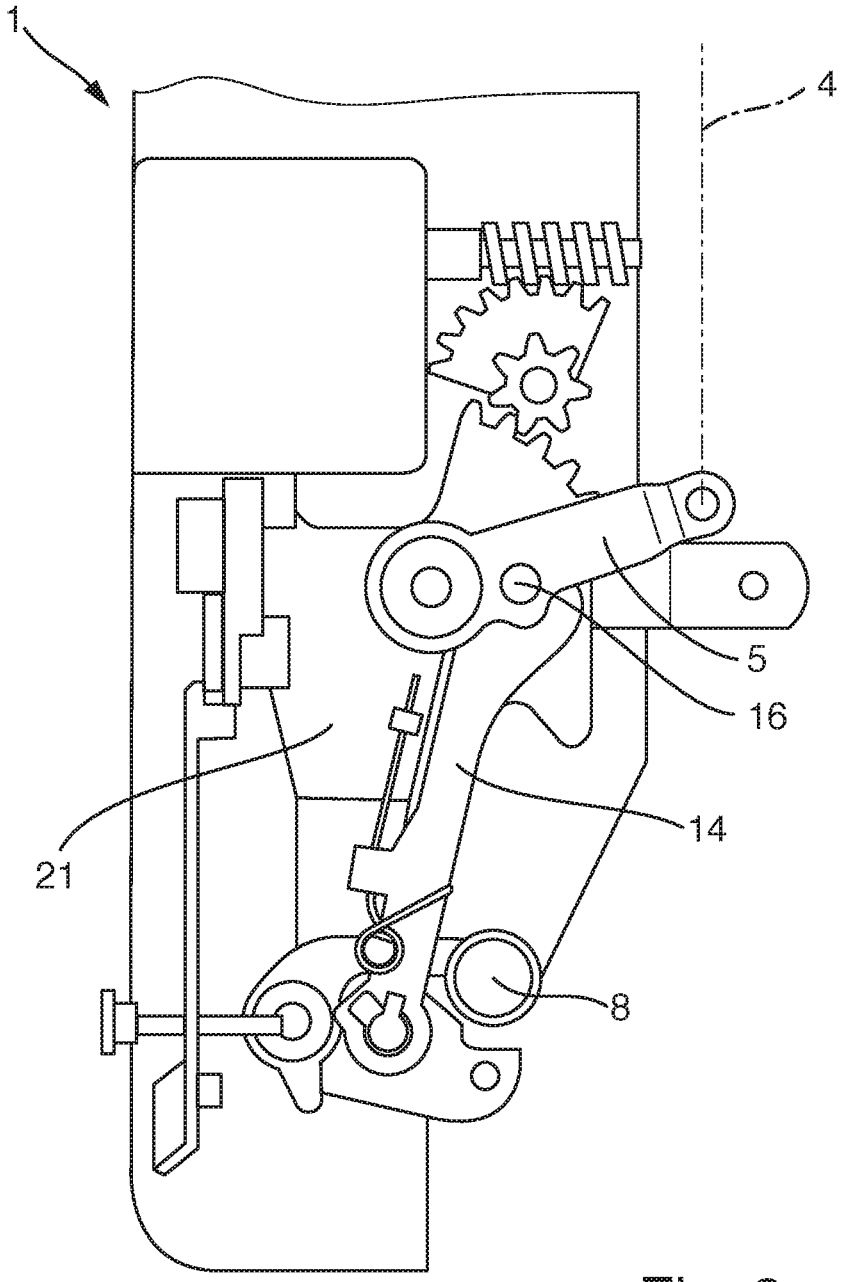
Figure 4:
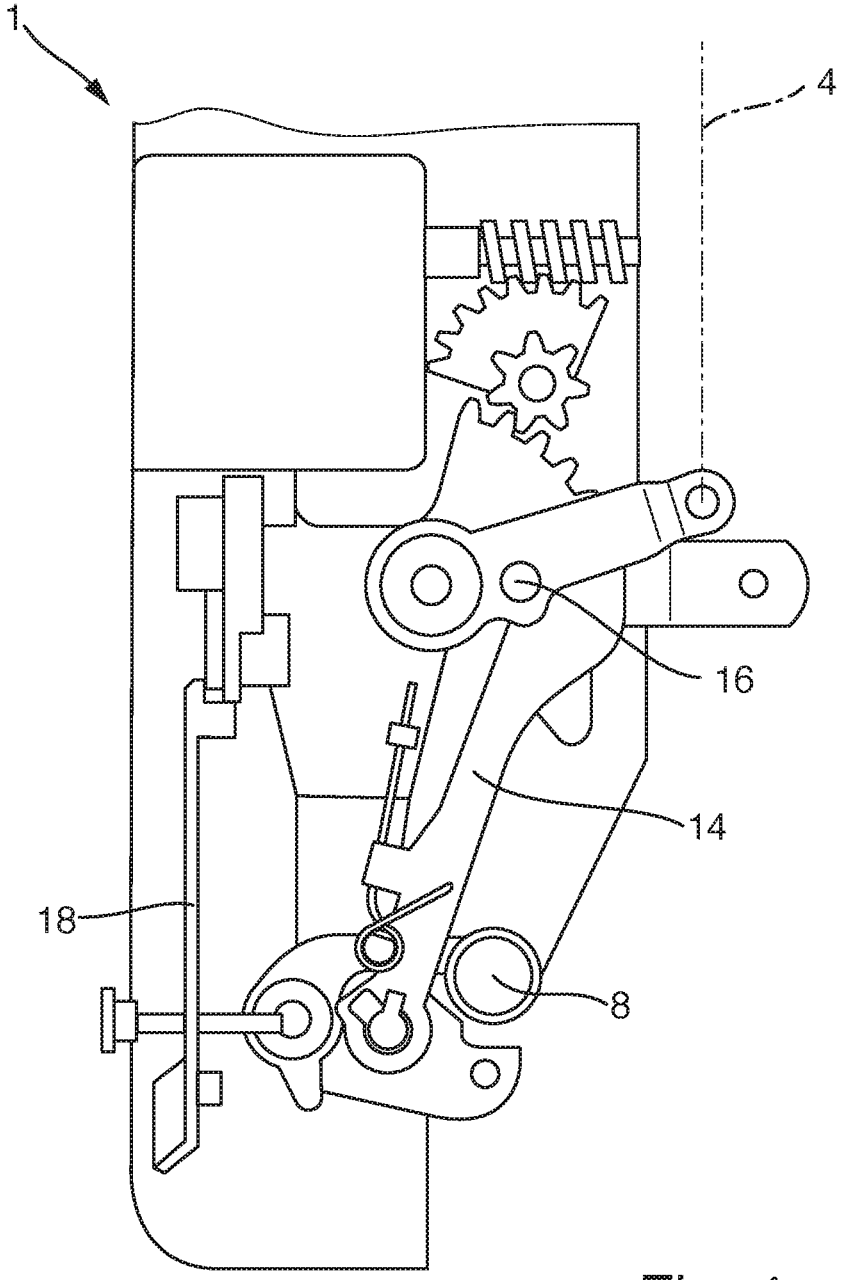
Figure 5:
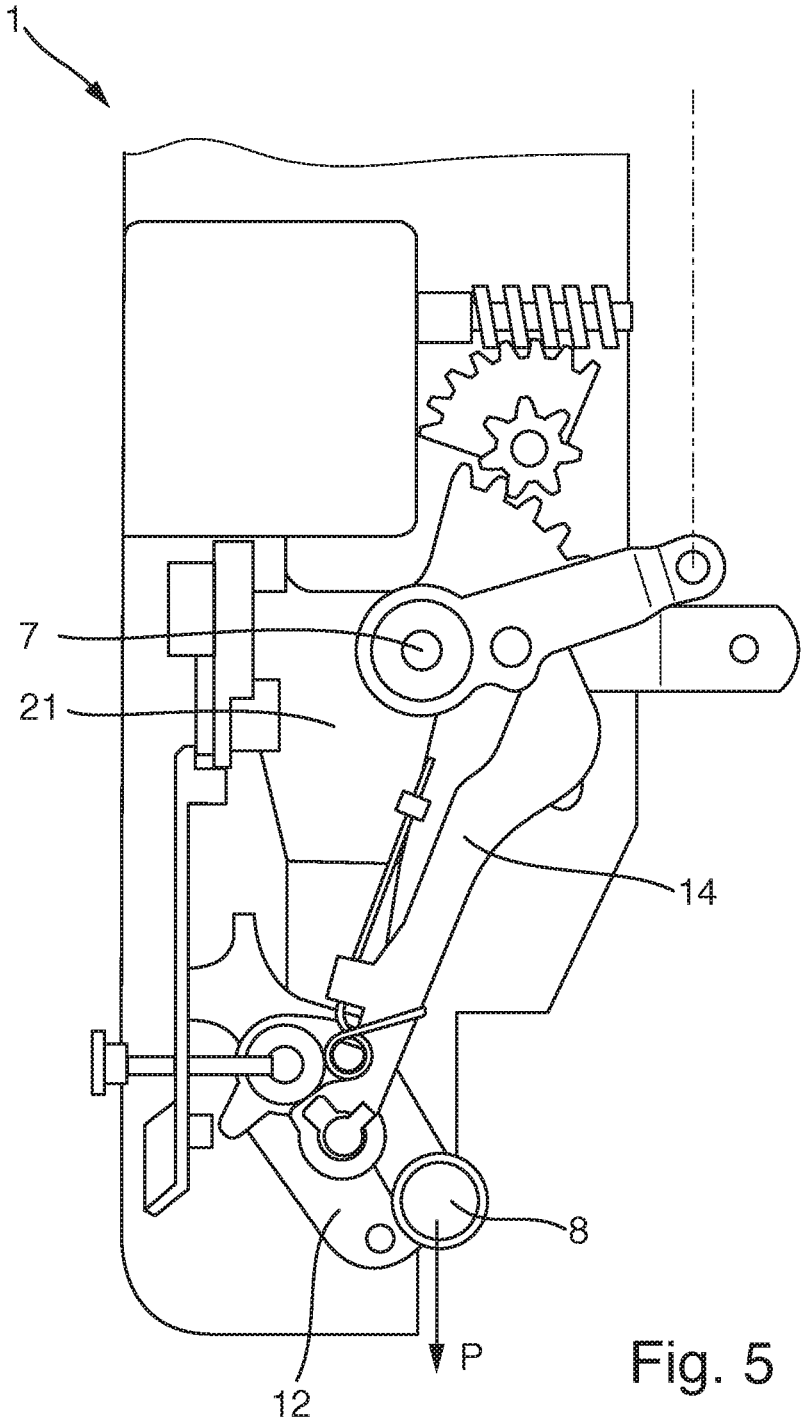
Figure 6:
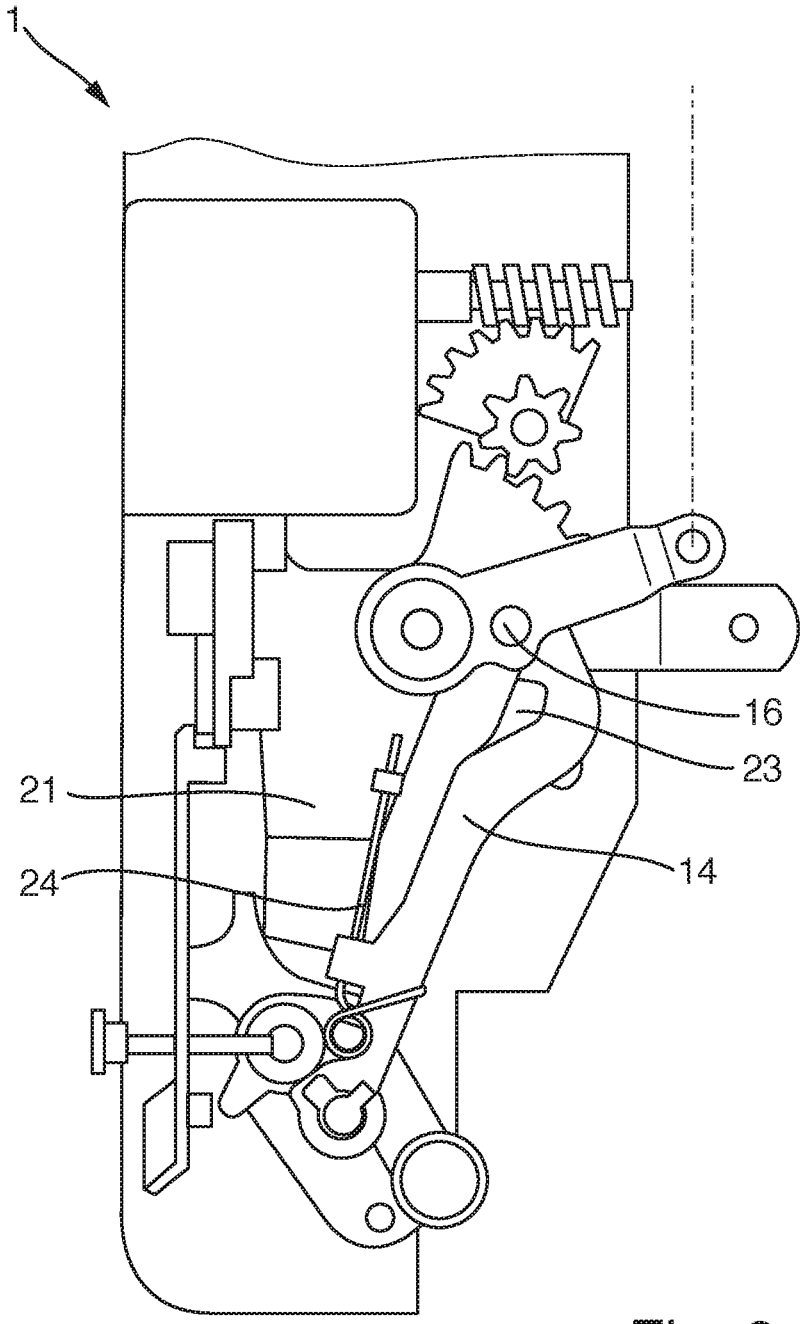
Figure 7:
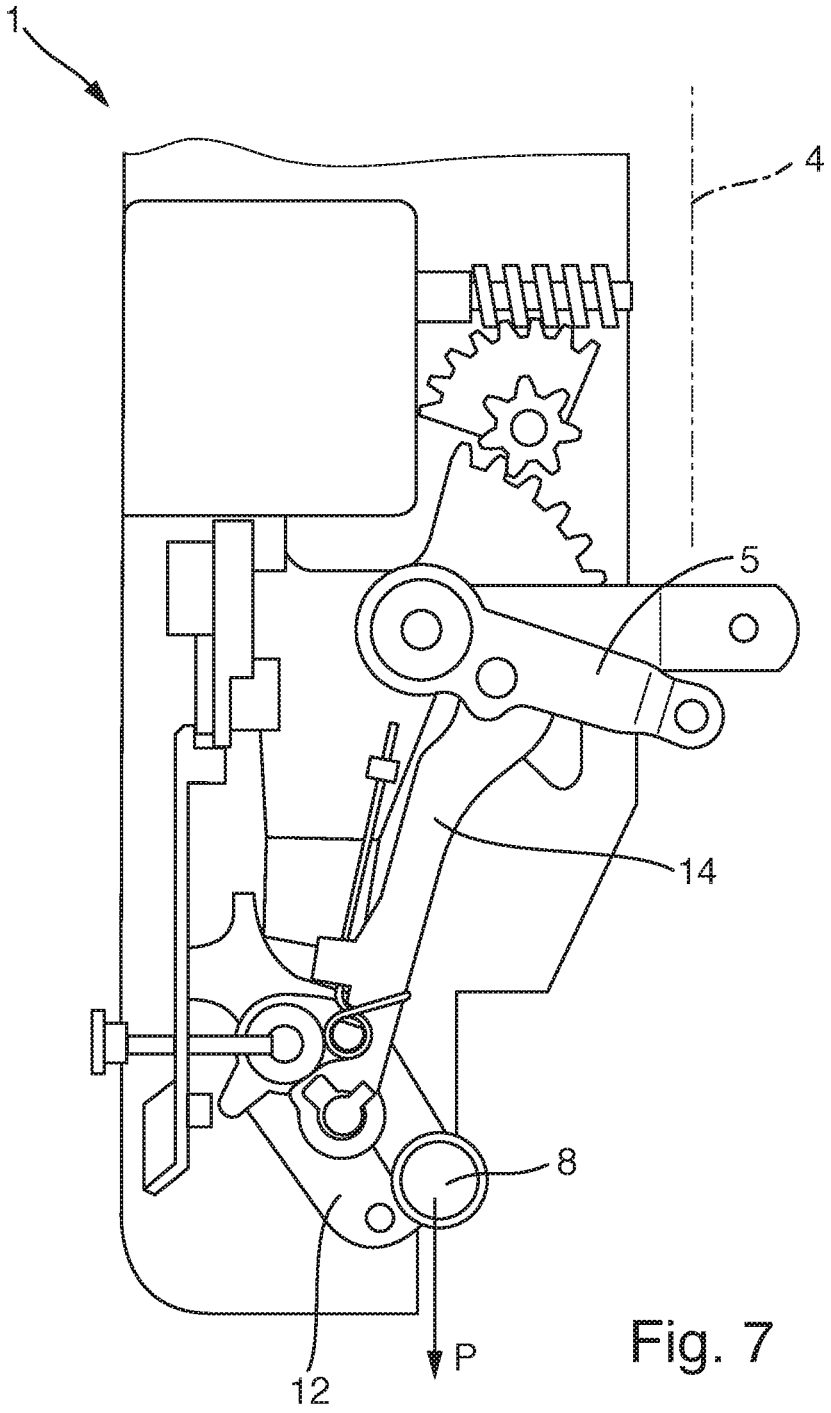
Figure 8:
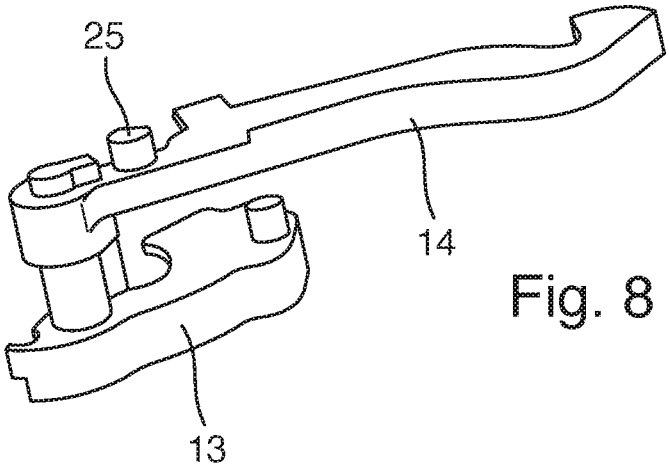
Figure 9:
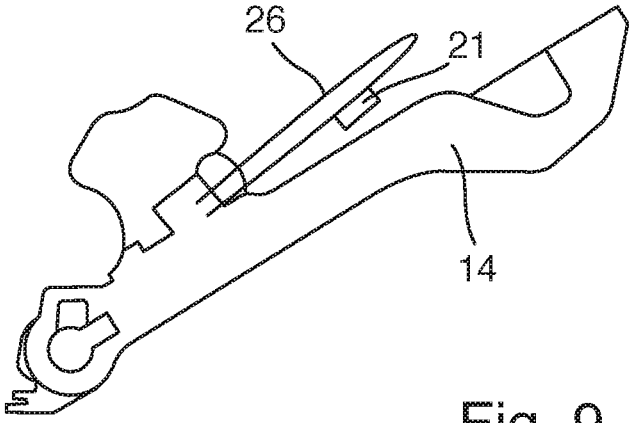

The following are shown:

FIG. 1 a three-dimensional view of an arrangement of a motor vehicle door latch and a theoretical position of an additional latch in an arrangement which serves as an example in a sliding door, with an indicated connection between the motor vehicle door latch and the additional latch, FIG. 2 a three-dimensional view onto a motor vehicle door latch according to FIG. 1, whereby the motor vehicle door latch is depicted without a housing lid and only with the constructional elements explaining the invention, FIG. 3 a lateral view of the opened motor vehicle latch according to FIG. 2 in a functional position unactivated and unbolted, FIG. 4 a lateral view of the motor vehicle latch according to FIG. 2 in the functional position unactivated and bolted, FIG. 5 a lateral view of a motor vehicle latch according to FIG. 2 in the functional position of the first activation lever activated and bolted, FIG. 6 a lateral view of a motor vehicle latch according to FIG. 2 in the functional position of the first activation lever activated and unbolted, whereby a convenience function is illustrated in this figure, FIG. 7 a lateral view of a motor vehicle latch according to FIG. 2 in a functional position of the first and second activation lever activated and primary and secondary latch unbolted, FIG. 8 a three-dimensional view of the accommodation of the coupling lever with an accommodation of the coupling lever in the motor vehicle latch serving as an example, and FIG. 9 a top view of a coupling lever according to the invention with an arranged bearing point in the motor vehicle door latch.

FIG. 1 shows a three-dimensional view of a motor vehicle door latch 1 in a theoretical position to a further motor vehicle door latch 2 in a theoretically depicted sliding door 3. In this arrangement, the motor vehicle door latch 1 forms the primary latch; in contrast, the further motor vehicle door latch 2 forms the secondary latch 2. The secondary latch 2 can also be described as an additional latch 2. A mechanical connection is theoretically depicted between the primary latch 1 and the additional latch 2 which can be a Bowden cable 4 for example. The Bowden cable 4 connects the second activation lever 5 to the triggering and/or activation lever 6 on the additional latch 2. The second activation lever 5 is pivotably accommodated in the primary latch 1 by means of the axis 7. A first activation lever 8 is only apparent in places here as the first activation lever 8 is concealed by the housing lid 9. The first activation lever 8 can also be activated by means of a Bowden cable, for example, whereby the Bowden cable is not illustrated, but can be inserted and fixed into the mounting 10 of the housing lid 9 for example.

In FIG. 2, the motor vehicle door latch or the primary latch 1 according to FIG. 1 is illustrated in a three-dimensional view but without a housing lid 9. Furthermore, only the components of the motor vehicle door latch 1 were illustrated which are significant in explaining the function of the invention. The same components are furnished with the same reference figures.

The first activation lever 8 is pivotably accommodated in the axis 11. A triggering lever 12 is arranged below the first activation lever 8 which is also accommodated on the axis 11. On activation of the first activation lever, the external activation lever 8 is moved against the triggering lever 12 so that an unrecognizable locking mechanism can be unlocked by means of a first coupling lever 13. The second coupling lever 14 is pivotably accommodated on the first coupling lever 13 and in particular on an extension 15 of the first coupling lever 13. The coupling lever 14 engages into the graded mandrel 16 on the second activation lever 5 in a form-fitting and detachable manner. The activation lever chain for activation of the secondary latch or additional latch 2 therefore takes place according to the illustrated embodiment example by means of the first activation lever 8, the triggering lever 12, the first coupling lever 13, the second coupling lever 14, the graded mandrel 16, the second activation lever 5 and the Bowden cable 4.

An internal locking lever 17, an internal activation lever 18 and an electrical drive 19, with a wormgear 20 are also apparent. The locking lever 21 can be electrically activated by means of the electrical drive and the wormgear. The locking lever can also be pivoted by means of the internal locking lever 17 and an external locking lever 22.

In the following FIGS. 3 to 7, the function of the primary latch 1 should be explained in interplay with the additional latch 2 and the functionalities resulting from the invention. In FIG. 3, the lateral view of the primary latch 1 is reproduced in a lateral view according to FIG. 2 without a housing lid 9. The state of the latch is illustrated in which the primary latch 1 is neither activated nor bolted. The first activation lever 8 is located in its starting position and the second coupling lever 14 engages into the graded mandrel 16 so that a mechanical connection is guaranteed between the first activation lever 8 and the second activation lever 5. All components such as also the locking lever 21 are located in a position in which the primary latch 1 and the additional latch 2 could be unlocked by means of an external door handle or an internal door handle, if these are activated.

In FIG. 4, the primary latch 1 is reproduced in turn in a lateral view according to FIG. 2 without a housing lid 9, whereby the also unactivated state is shown here; however, the primary latch 1 is present in the bolted state. Unactivated means that neither the internal activation lever nor the external activation lever or the first activation lever 8 are activated. The bolted state also means that the first coupling lever 13 is disengaged from the locking mechanism and that the second coupling lever 14 was pivoted around an angle in a clockwise direction so that the second coupling lever 14 is disengaged from the graded mandrel 16. Activation of the internal or external activation lever 8, 18 would consequently not lead to unlocking of the main latch 1 and the additional latch 2 as both the first coupling lever 13 and the second coupling lever 14 are disengaged.

In FIG. 5, in turn, a lateral view on the primary latch 1 is reproduced according to FIG. 2 without a housing lid 9, whereby the activated and bolted state is illustrated. According to FIG. 4, the primary latch 1 was present in the bolted state so that the first and second coupling levers 13, 14 were disengaged. In FIG. 5 the external activation lever or first activation lever 8 was pivoted in the direction of the arrow P. The consequence of pivoting of the first activation lever 8 is that the triggering lever 12 and also the second coupling lever 14 are also moved in the direction of the arrow P. However, as the bolted state is present, the movement of the first activation lever 8 has no effect on the primary latch 1 and the additional latch 2, so that an operator who pulls the external door handle cannot open the door.

In order to bolt the primary latch 1 and the secondary latch 2 the external locking lever 22 was pivoted around the axis 7 so that both the second coupling lever 14 and also the first coupling lever 13 were disengaged.

In FIG. 6, the execution of a convenience function according to the invention is now reproduced for the additional latch 2. If the primary latch 1 is electrically unbolted, for example, in the state according to FIG. 5, in which the first activation lever was activated, the locking lever 21 thus moves in a clockwise direction into the position illustrated in FIG. 6. However, the second coupling lever 14 cannot engage into the graded mandrel 16 as the contour 23 which engages into the graded mandrel 16 is located below the graded mandrel 16. In this case, the spring 24 pre-tensions the second coupling lever 14 so that the "Unbolted" function is saved. Saving of the "Unlocking" function constitutes the convenience function. If the second coupling lever reverts to its starting position after release of the external door handle, for example, the spring force of the spring 24 causes the contour 23 to engage with the graded mandrel 16 without requiring a further action by an operator. The "Unbolted" function is assumed independently so that with repeated activation of the external door handle the locking mechanisms of the primary latch 1 and the secondary latch 2 are unlocked.

In FIG. 7, in turn, the lateral door latch or primary latch is reproduced according to FIG. 2 without a housing lid 9, namely in the activated and unbolted state. In the embodiment example, in turn, the external activation lever or the first activation lever 8 is pulled in the direction of the arrow P, whereby the triggering lever 12 is moved and the locking mechanism of the primary latch 1 is unlocked. Furthermore, the second activation lever 5 is pivoted by means of the coupling lever 14 so that by means of a movement of a Bowden cable 4, for example, the additional latch 2 can also be unlocked.

In FIG. 8, the second coupling lever 14 is reproduced in relation to accommodation on the first coupling lever 13. A dual component construction is illustrated consisting of a first and second coupling lever 13, 14; however, it is also conceivable to execute the first and second coupling levers 13, 14 as a single-component construction. If the spring 24 is accommodated on the elevation 25 for storage of the convenience function and engages into the locking lever 21 with the long spring leg, so that a relative force can be executed between the coupling lever 14 and the locking lever 21, it is also conceivable to mold a spring arm 26 to the second coupling lever 14 as a single component, whereby the spring arm 26 assumes the convenience function and interacts with the locking lever 21 for storage of the convenience function.

Formation of the second coupling lever 14 with a spring arm 26 is reproduced as an example in FIG. 9.

LIST OF REFERENCE SYMBOLS

1 motor vehicle door latch, primary latch
2 further motor vehicle door latch, secondary latch
3 sliding door
4 mechanical connection, Bowden cable
5 second activation lever
6 triggering and/or activation lever on the additional latch
7 axis
8 first activation lever
9 housing lid
10 mounting
11 axis, first activation lever
12 triggering lever
13 first coupling lever
14 second coupling lever
15 extension
16 graded mandrel
17 internal locking lever
18 internal activation lever
19 electrical drive
20 wormgear
21 locking lever
22 external locking lever
23 contour
24 spring
25 mounting
26 spring arm
P arrow

The invention claimed is:

1. A motor vehicle door latch assembly comprising:

a primary latch having a first housing including a first locking mechanism with a catch and at least a pawl, a triggering lever configured to unlock the first locking mechanism, a bolting device, a first coupling lever, wherein the triggering lever interacts with the bolting device by way of the first coupling lever, an activation lever engageable against the triggering lever whereby the first locking mechanism is at least indirectly unlockable by the activation lever, and a second coupling lever connected to the first coupling lever and a secondary latch having a second housing separate from the first housing and including a secondary locking mechanism that is activated by the activation lever via interactions by the activation lever and the triggering lever, the triggering lever and the first coupling lever, the first coupling lever and the second coupling lever, and the second coupling lever and the secondary latch, wherein the first coupling lever and the second coupling lever have a common pivoting axis, and wherein the second coupling lever is connected to the first coupling lever by a bayonet latch.

2. The motor vehicle door latch assembly according to claim 1, wherein the first coupling lever is elongated along the common pivoting axis of the first coupling lever and the second coupling lever is pivotably accommodated on the common pivoting axis whereby the second coupling lever extends from the common pivoting axis of the first coupling lever.

3. The motor vehicle door latch assembly according to claim 2, wherein the first coupling lever is pivotably accommodated in the triggering lever, wherein the first coupling lever and the common pivoting axis extends through the triggering lever.

4. The motor vehicle door latch assembly according to claim 1, wherein the first coupling lever and the second coupling lever are configured to execute concurrent angular movements.

5. The motor vehicle door latch assembly according to claim 4, wherein the first coupling lever and the second coupling lever have the same angular movement.

6. The motor vehicle door latch assembly according to claim 1, wherein the first coupling lever and the second coupling lever are formed as a single component.

7. The motor vehicle door latch assembly according to claim 1, wherein the first coupling lever and the second coupling lever are made of plastic.

8. The motor vehicle door latch assembly according to claim 1, wherein the bolting device has a pivotably accommodated locking lever.

9. The motor vehicle door latch assembly according to claim 1, wherein the first coupling lever and the second coupling lever are made of an injection-molded plastic component.

10. The motor vehicle door latch assembly according to claim 1, wherein the first coupling lever and the triggering lever are connected by a bayonet latch.

11. The motor vehicle door latch assembly according to claim 1, wherein the second coupling lever is rotatable in a rotational plane that is perpendicular to the common pivoting axis.

12. The motor vehicle door latch assembly according to claim 1, wherein a portion of the first coupling lever is cylindrical in shape and has an extending portion that extends radially from an end of the first coupling lever.

13. The motor vehicle door latch assembly according to claim 12, wherein the second coupling lever extends from the first coupling lever in a direction in which the extending portion of the first coupling lever extends.

14. The motor vehicle door latch assembly according to claim 1, wherein the triggering lever is engaged with an axial end of the first coupling lever and the second coupling lever is engaged with an opposite axial end of the first coupling lever.

15. The motor vehicle door latch assembly according to claim 14, wherein the triggering lever is rotatable in a first rotational plane that is parallel with a second rotational plane of the second coupling lever.

16. A motor vehicle door latch comprising:

a first locking mechanism with a catch and at least a pawl, a triggering lever configured to unlock the first locking mechanism, a bolting device, a first coupling lever, wherein the triggering lever interacts with the bolting device by way of the first coupling lever, an activation lever engageable against the triggering lever whereby the locking mechanism is at least indirectly unlockable by the activation lever, and a second coupling lever connected to the first coupling lever and a secondary motor vehicle latch having a secondary locking mechanism that is activated by the activation lever via sequential interactions by the activation lever and the triggering lever, the triggering lever and the first coupling lever, the first coupling lever and the second coupling lever, and the second coupling lever and the secondary motor vehicle latch, wherein the first coupling lever and the second coupling lever have a common pivoting axis, wherein the first coupling lever is elongated along the common pivoting axis of the first coupling lever and the second coupling lever is pivotably accommodated on the common pivoting axis whereby the second coupling lever extends from the common pivoting axis of the first coupling lever, and wherein the first coupling lever is pivotably accommodated in the triggering lever, wherein the first coupling lever and the common pivoting axis extends through the triggering lever.

17. A motor vehicle door latch comprising:

a first locking mechanism with a catch and at least a pawl, a triggering lever configured to unlock the first locking mechanism, a bolting device, a first coupling lever, wherein the triggering lever interacts with the bolting device by way of the first coupling lever, an activation lever engageable against the triggering lever whereby the locking mechanism is at least indirectly unlockable by the activation lever, and a second coupling lever connected to the first coupling lever and a secondary motor vehicle latch having a secondary locking mechanism that is activated by the activation lever via sequential interactions by the activation lever and the triggering lever, the triggering lever and the first coupling lever, the first coupling lever and the second coupling lever, and the second coupling lever and the secondary motor vehicle latch, wherein the first coupling lever and the second coupling lever have a common pivoting axis, wherein the first coupling lever and the triggering lever are connected by a bayonet latch.

* * * * *